United States Patent [19]

Keller

[11] 3,930,776

[45] Jan. 6, 1976

[54] HYDRAULIC WRENCH

[75] Inventor: Philip J. Keller, Pompton Plains, N.J.

[73] Assignee: Unex Corporation, Montclair, N.J.

[22] Filed: Aug. 16, 1974

[21] Appl. No.: 498,246

[52] U.S. Cl. ..... 173/163; 74/128; 74/156; 81/57.39

[51] Int. Cl.[2] ..... B25B 13/46

[58] Field of Search ..... 173/163; 81/57.32, 57.39, 81/57.44; 74/128, 156

[56] References Cited

UNITED STATES PATENTS

| | | | |
|---|---|---|---|
| 2,573,469 | 10/1951 | Maclay | 74/156 |
| 2,758,569 | 8/1956 | Peterson | 74/128 X |
| 2,844,982 | 7/1958 | Swenson | 173/93.5 X |
| 3,706,244 | 12/1972 | Wilmeth | 81/57.39 X |
| 3,791,230 | 2/1974 | Webb | 74/128 X |

*Primary Examiner*—Frank L. Abbott
*Assistant Examiner*—William F. Pate, III
*Attorney, Agent, or Firm*—Michael S. Striker

[57] ABSTRACT

A hydraulic wrench has a support, and a drive assembly which is mounted thereon and which includes a shaft that is turnable, a pair of sector drive plates which are mounted on the shaft turnable relative to the same and spaced from one another, each drive plate having an arcuate edge face formed with a plurality of slots that are spaced about the axis of the shaft and extend substantially parallel to this axis, and a square drive member which is turnable with the shaft and can be inserted into a mating drive socket. A transmission arrangement transmits motion from the sector drive plates to the shaft in order to turn the latter when the sector drive plates are turned. A hydraulic cylinder unit is also mounted on the support for pivotal movement about an axis parallelling that of the shaft and spaced therefrom, and the cylinder unit has a reciprocable piston rod having a working stroke and being provided with a projection that can engage in the respective slots of the sector drive plates, in order to turn the latter during the working stroke of the piston rod.

9 Claims, 6 Drawing Figures

FIG. 4
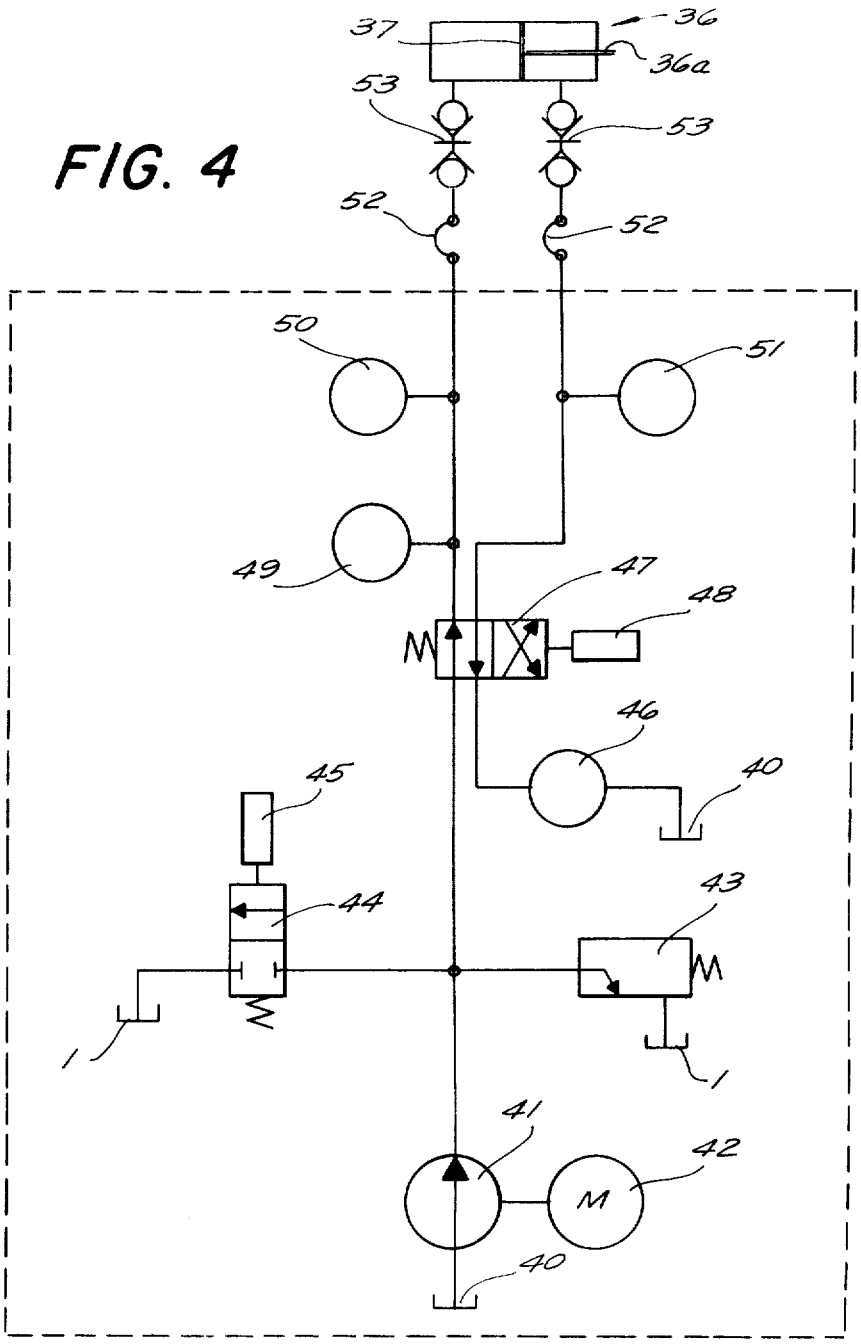
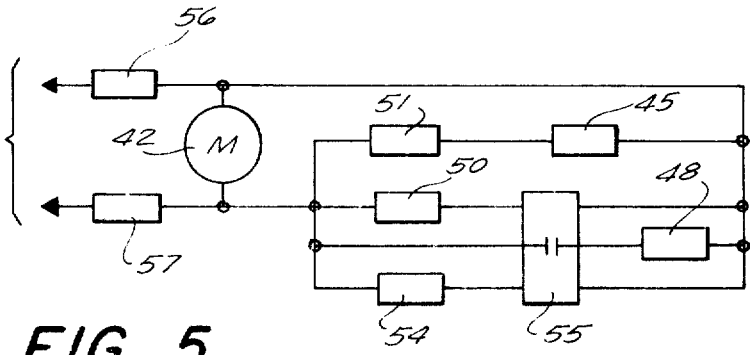
FIG. 5

HYDRAULIC WRENCH

BACKGROUND OF THE INVENTION:

The present invention relates generally to wrenches, and more particularly to hydraulic wrenches. Specifically the invention relates to a novel hydraulic torque wrench.

Wrenches of many different kinds, including torque wrenches, are well known in the art. Particularly when heavy industrial equipment must be serviced, special tools such as torque wrenches are required to tighten and loosen the large threaded fasteners used in such equipment. These special wrenches must be capable of developing a high, controllable torque.

It is known from the prior art to provide for such applications either impact wrenches, geared wrenches or hydraulic wrenches. All of these are capable of developing high torque, but all of them are subject to various disadvantages that make further developments in this field desirable.

Impact wrenches do develop the same driving torque when operating in two opposite directions. However, they operate constantly at peak power and thus make it impossible in many cases to loosen a fastener, e.g. a corroded nut or bolt, with the same impact that previously tightened it, because corroded fasteners evidently require a higher loosening torque. This cannot be provided in an impact wrench, because such wrenches do not have variable torquing. This may require a mechanic to bring two impact wrenches to the job site, one wrench to loosen the fasteners and another wrench to tighten the fasteners. Moreover, poor control of the striking blows of an impact wrench is frequently observed, resulting in fasteners which are either over-torqued or under-torqued. Evidently, this can lead to damaged fasteners, or to additional time spent in retightening loose fasteners, leading therefore to higher servicing costs.

Gear wrenches are not possessed of the same disadvantages as impact wrenches: however, gear wrenches develop their high torque through large gear reductions, meaning that they operate at a relatively slow rate of speed, which increases the servicing time required for tightening or loosening fasteners with such wrenches. Moreover, because of the large number of gears required in order to obtain the desired speed reduction, gear wrenches are inefficient, and furthermore because of this number of gears the wrenches are necessarily large and cannot be used in many instances where space is limited.

Prior-art hydraulic wrenches, finally are of such construction that they cannot be employed universally. In other words, as a general rule, wrench sockets and reaction members on these wrenches must be exchanged every time a fastener of a different type or size than the previous one is to be tightened or loosened. Evidently, this is time-consuming, quite aside from the fact that different wrench sockets and reaction members must be available at all times for switching over to different jobs. Also, the prior-art hydraulic wrenches require frequent operator adjustment and are subject to frequent jamming, so that they have not found wide acceptance in the industry.

SUMMARY OF THE INVENTION:

Accordingly, it is an object of the invention to overcome the disadvantages of the prior art.

More particularly, it is an object of the present invention to provide an improved hydraulic torque wrench which is not possessed of any of the disadvantages of the prior-art wrenches, whether they be of the hydraulic or any other type.

A further object of the invention is to provide such a hydraulic torque wrench which is capable of applying a high, controlled torque to a fastener via an intermediate socket wrench.

An additional object of the invention is to provide such a novel hydraulic torque wrench which is simple and uncomplicated in its construction.

Still a further object of the invention is to provide such a hydraulic torque wrench which is semiautomatic in operation.

A concomitant object of the invention is to provide such a novel hydraulic torque wrench which can be handled easily and used by skilled or unskilled operators alike.

In keeping with these objects, and with others which will become apparent hereafter, one feature of the invention resides in a hydraulic torque wrench which, briefly stated, comprises a support, a drive assembly mounted on the support and including a shaft turnable about a first axis, a sector drive plate turnable on the shaft and having an arcuate edge face formed with a plurality of slots spaced about the first axis and extending substantially parallel to the same, and a square drive member turnable with the shaft and adapted for insertion into a mating drive socket. Transmission means is provided for transmitting motion from the sector drive plate to the shaft so as to turn the latter. A hydraulic cylinder unit is mounted on the support for pivotal movement about a second axis spaced from and parallel to the first axis, and this cylinder unit includes a reciprocable piston rod having a working stroke. A projection is provided on the piston rod for engagement in the respective slots, so as to turn the sector drive plate on the shaft during the working stroke of the piston rod.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS:

FIG. 4 shows the hydraulic circuit of the torque wrench in FIGS. 1–3;

FIG. 5 is an electrical block diagram showing the electrical circuit of the torque wrench in FIGS. 1–3.

Figure 1:
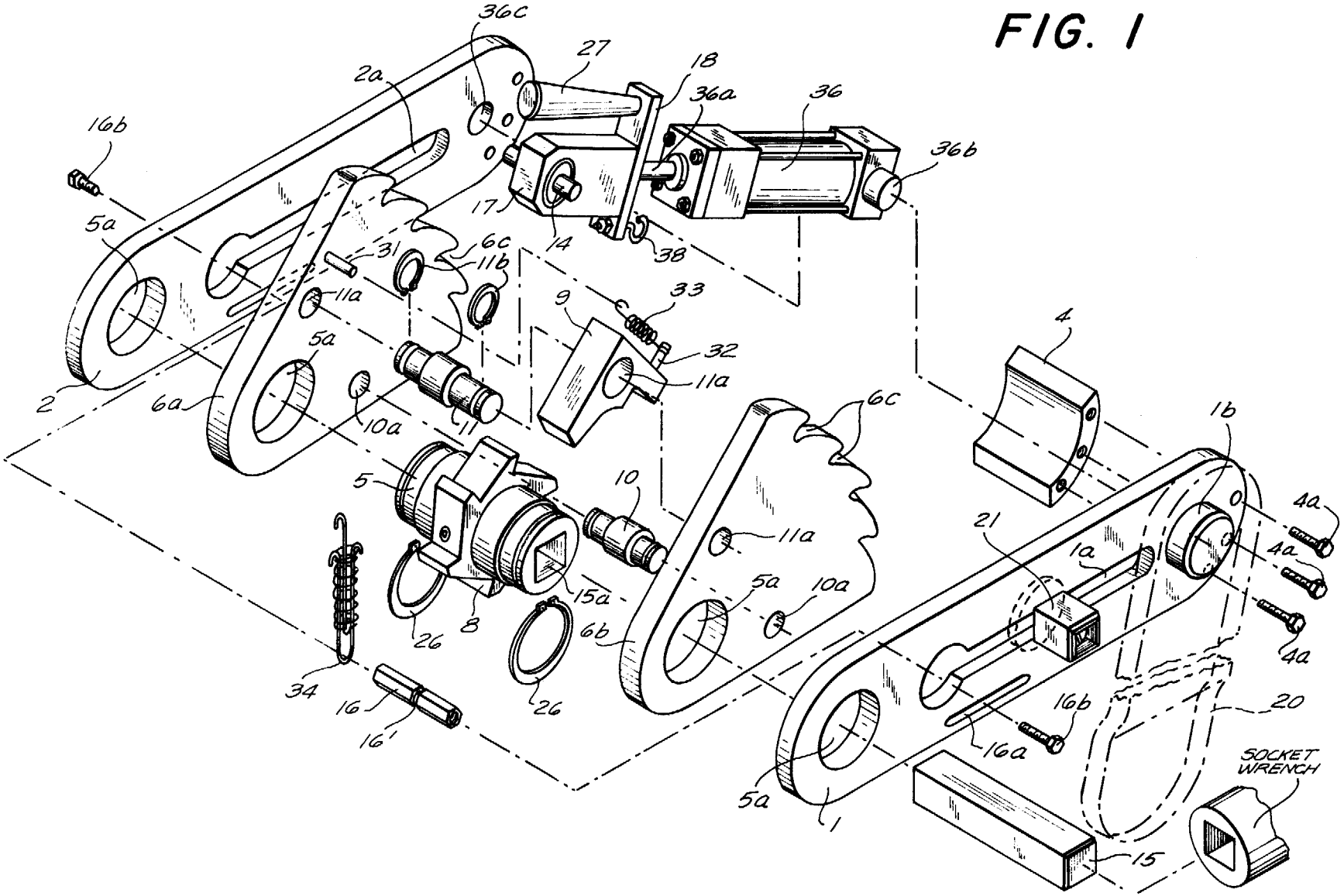
FIG. 1 is an exploded isometric view of a hydraulic torque wrench according to the present invention.

DESCRIPTION OF THE PREFERRED EMBODIMENTS:

Referring now to FIGS. 1–5, wherein a single currently preferred embodiment of the invention has been illustrated, it will be seen that reference numerals 1 and 2 identify a pair of transversely spaced side plate members constituting part of the support or frame of the novel torque wrench. The plate members 1 and 2 are provided with respective elongated slots 1*a* and 2*a*, respectively, and at one end they are each provided with an outwardly projecting boss 1*b* (only one visible in FIG. 1, both shown in FIG. 3) to which a reaction arm 20 can be releasably connected.

Mounted between the side plates 1 and 2 is a drive assembly comprising a pair of sector drive plates 6*a* and 6*b*, each having an arcuate edge face formed with a plurality of spaced slots 6*c*. A shaft 5 extends through aligned holes 5*a* in the drive plates 6*a*, 6*b* and the plate members 1 and 2; it is held against displacement relative to the plates and plate members by circlips 26 which are snapped onto the shaft 5 at the outwardly directed sides of the plate members 1 and 2, respectively. Intermediate the sector drive plates 6*a* and 6*b* the shaft 5 is provided with a ratchet wheel 8 having the illustrated teeth. Unlike the sector drive plates 6*a* and 6*b*, which can turn relative to the shaft 5, the ratchet drive wheel 8 is fixedly connected with the shaft 5 so as to turn with the same, but not relative to the same. It could, of course, be made of one piece with the shaft 5. A pawl 9 is turnably journalled on a post 11 which extends through registering holes 11*a* in the pawl 9 and the sector drive plates 6*a* and 6*b*. Circlips 11*b* are snapped on to the end portions of the post 11 adjacent the outwardly sides of the sector drive plates 6*a*, 6*b* to prevent shifting of the post 11 in longitudinal direction of the latter. A pin 32 is provided on the pawl 9, and a pin 31 is provided on one or both of the sector drive plates 6*a*, 6*b*; a spring 33 is connected with its opposite ends to the pins 31 and 32, respectively, so that in FIG. 1 and FIG. 2, the pawl 9 will always be urged to pivot in the counterclockwise direction, so as to engage with the teeth of the ratchet wheel 8. A spacer post 10 extends into aligned holes 10*a* in the sector drive plates 6*a*, 6*b* to provide further stability to the assembly; it, also, is secured by circlips (not shown) analogous to the circlips 11*b*.

A hydraulic cylinder unit 36 is provided at one end with pivots 36*b*, by means of which it is connected with the plate members 1 and 2 at a location that is spaced longitudinally of the plate members 1 and 2 from the shaft 5. The cylinder unit 36 can therefore tilt or pivot about a pivot axis, defined by the pivots 36*b*, which extends parallel to the axis of rotation of the shaft 5. The cylinder unit 36 has a double-acting piston 37 in its interior (see FIG. 4) which piston 37 is provided with a piston rod 36*a* that extends outwardly from the unit 36 and carries a handlebar 18 on which a handle 27 is provided for engagement by an operator. Provided on the handlebar 18 is a pin 14 which projects to opposite lateral sides of the handlebar 18 in substantial parallelism with the pivot axis defined by the pivots 36*b*, so that the end portions of the pin 14 can engage into the slots 6*c* of the respective sector drive plates 6*a*, 6*b*. To assure such engagement, the handlebar 18 is also provided with a hook 38 to which one end of a spring 34 is secured, which spring forms in the region of its other end a loop that is received in an exterior groove 16′ formed in a spacer bar 16 that is formed in its opposite axial ends with tapped holes into which bolts 16*b* are threaded that extend through slots 16*a* formed in the plate members 1 and 2, respectively. The spring 34 thus permanently tends to tilt the unit 36 about the pivot axis defined by the pivots 36*b* in counterclockwise direction, so as to assure engagement of the pin end portions of the pin 14 in the slots 6*c* of the sector drive plates 6*a*, 6*b*, respectively. The pivots 36*b* extend into holes 36*c* formed in the plate members 1 and 2, respectively. The end of the wrench where the pivots 36*b* are located, is closed by a curved end plate 4 formed with tapped bores into which bolts 4*a* can be threaded which extend through appropriate holes in the plate members 1 and 2, respectively. A reaction drive socket 21 is mounted in one of the slots 1*a* (and can be made releasable so that it can be placed into the other slot 2*a*) and formed with a recess so dimensioned that it can receive a portion of a fastener adjacent to that fastener which is to be loosened or tightened with the novel wrench. If the socket 21 is not to be used alone, then the arm 20 is put in place and used as the reaction arm in combination with the socket 21. Socket 21 could also be replaced by a standard socket wrench and a fastener for retaining it on the respective plate 1 or 2. A reaction member temporarily fastened to plate members 1 and 2 and projecting outwardly in direction of elongation of the drive member 15 but exceeding the projecting length of the same, could also be used to react against stationary objects adjacent to the fastener to be loosened or tightened. Such a reaction member could be magnetic to overcome the tool's tendency to lift away from the reaction point during the retracting stroke.

The opposite axial ends of the shaft 5 are formed with polygonal recesses 15*a* which extend axially inwardly (only one shown) and into which a square drive member 15 in form of a bar or the like is inserted, to be retained therein in suitable manner, for instance by means of a set screw or the like. This square drive member 15 projects outwardly of that end of the shaft 5 where it is mounted (depending upon at which side of the wrench the square drive member 15 is to be utilized) and is to be inserted into a standard socket wrench (see FIG. 1) which, in turn, is engaged with the fastener that is to be loosened or tightened.

The novel wrench thus far described has a hydraulic circuit that is shown in FIG. 4, and an electrical circuit that is shown in FIG. 5.

In FIG. 4, reference numeral 40 identifies a reservoir for hydraulic fluid, reference numeral 41 a pump which is driven by a motor 42, reference numeral 43 a relief valve, reference numeral 44 a two position one-way valve that is operated by a solenoid 45. A filter 46 is provided for filtering contaminants out of the hydraulic fluid. Reference numeral 47 identifies a two position four-way valve which is operated by a solenoid 48. Reference numeral 49 identifies a pressure gauge, reference numeral 50 a pressure switch and reference numeral 51 a further pressure switch both of which are either preset or adjustable to certain pressures. Reference numeral 52 identifies a pair of flexible lines by means of which the hydraulic circuit is connected via a pair of quick disconnect couplings 53 (shown only diagrammatically) with the cylinder unit 36.

The electrical circuit is shown in FIG. 5, and the various solenoids described with respect to FIG. 4 are indicated in FIG. 5 with the same reference numerals.

Reference numeral 54 identifies a control switch which operates a latching relay 55, reference numeral 56 identifies a circuit breaker of conventional type, and reference numeral 57 an operator-operable motor switch for the motor 42. The arrows at the left-hand side of the diagram in FIG. 5 indicate the connection to a source of electrical energy, for instance an outlet for 110–115 volts A/C. It will be seen that a socket wrench into which the square drive member 15 has been inserted, and which in turn is engaged with a fastener to be loosened or tightened, is driven via the unit 36 through the two illustrated ratchet mechanisms. The first mechanism, which can also be considered the input mechanism, has the plates 6*a* and 6*b*, and these plates are driven by the pin 14 of the piston rod 36*a*. When they turn about the shaft 5, the pawl 9 moves with them and, since it engages the teeth of the ratchet wheel 8, turns the ratchet wheel and therefore the shaft 5. This second or output ratchet mechanism thus turns the square drive member 15. Activation of the output ratchet mechanism is accomplished by manually resetting the sector plates 6*a*, 6*b* to their original positions after the piston 37 and cylinder rod 36*a* have completed their working stroke and all of the slots 6*c* have been engaged by the pin 14.

Because of the arcuate configuration of the edge faces of the sector drive plates 6*a*, 6*b* wherein the slots 6*c* are formed, the unit 36 can act through a large driving radius, resulting in a smaller force being required to produce a given torque and permitting a smaller cylinder unit 36 to be used. A further advantage of the use of the sector drive plates 6*a*, 6*b*, for example vis-a-vis the use of drive plates of circular configuration, is that they permit the tool to be used in spaces where the employment of circular drive plates will make the tool so large that it could no longer be used.

The conversion of the linear motion of the piston rod 36*a* into the circular motion of the drive affects the torque output, because of the chordal height change which results from the geometry of this motion. This affect is, however, minimized by using a short cylinder unit 36 and driving through a large radius, whereby a more efficient drive is obtained, and whereby the short cylinder unit 36 and the short stroke of the piston 37 assure that a small overall size of the wrench can be maintained.

The short cylinder stroke requires the drive to move through small angular increments. To accomplish this, a conventional single ratchet drive would have to have a large number of teeth that are subjected to high load, meaning that many large teeth and a large-diameter ratchet wheel, or a multi-pawl mechanism with load-sharing problems would have to be employed. All of these disadvantages are, however, avoided in the present construction where the input ratchet arrangement utilizing the sector drive plates 6*a*, 6*b* performs the small angular movements on a large radius where the loading is smallest, whereas the output ratchet arrangement incorporating the ratchet wheel 8 performs larger angular movements. This makes is possible to utilize for the ratchet wheel 8 a few large teeth and to make the wheel 8 of a small diameter. Also, a single pawl 9 can be used, which eliminates load-sharing problems.

It is evident that rotation of the square drive member 15 can be effected in one direction or in an opposite direction merely by changing the square drive member 15 from one side to the other side of the tool, so that the wrench can be used to tighten as well as loosen any fasteners.

In operation of the novel wrench, a suitable socket wrench is attached to the free end of the square drive member 15 and is placed onto a fastener that is to be tightened or loosened. The reaction arm 20 is placed onto one of the bosses 1*b*, if the arm 20 is to be used. If the arm 20 is not to be used, then the reaction drive member 21 is connected with another one of the fasteners, but not the one that is to be tightened or loosened. The hydraulic unit of FIG. 4 is connected by means of the quick disconnect couplings 53 with the unit 36, and the pressure switch 50 is adjusted to the desired torque setting. The hydraulic pump motor 42 is switched on by means of the motor switch 57, and the cylinder rod 36*a* begins to extend, turning the square drive member 15 and the socket wrench attached to it, in the manner previously described. When the piston rod 36*a* reaches full extension, the system pressure in the system of FIG. 4 builds up, activating the pressure switch 50 which transmits a signal to the electrical latching relay 55 which, in turn, activates the solenoid 48 to change the position of the valve 47. With the valve 47 in the new position, the cylinder piston rod 38*a* retracts until the pin 14 engages in the next-following slot 6*c* of the sector drive plates 6*a*, 6*b*, that is the slot which is spaced circumferentially of the shaft 5 from the slot in which the pin 14 has heretofore been engaged. When the rod 36*a* is fully retracted, system pressure in the hydraulic system of FIG. 4 builds up again, until the pressure switch 51 is actuated which then opens the valve 44, allowing the output of the pump 41 to flow to the hydraulic reservoir 40.

In order to turn the fastener that is to be tightened or loosened further, the electrical switch 54 is closed by the operator in order to relieve the latching relay 55. This deenergizes the solenoid 48 of the valve 47, allowing the valve 47 to return to its original position with the result that the pressure switch 51 opens and the valve 44 closes, thereby starting the operating cycle over again.

Figure 2:
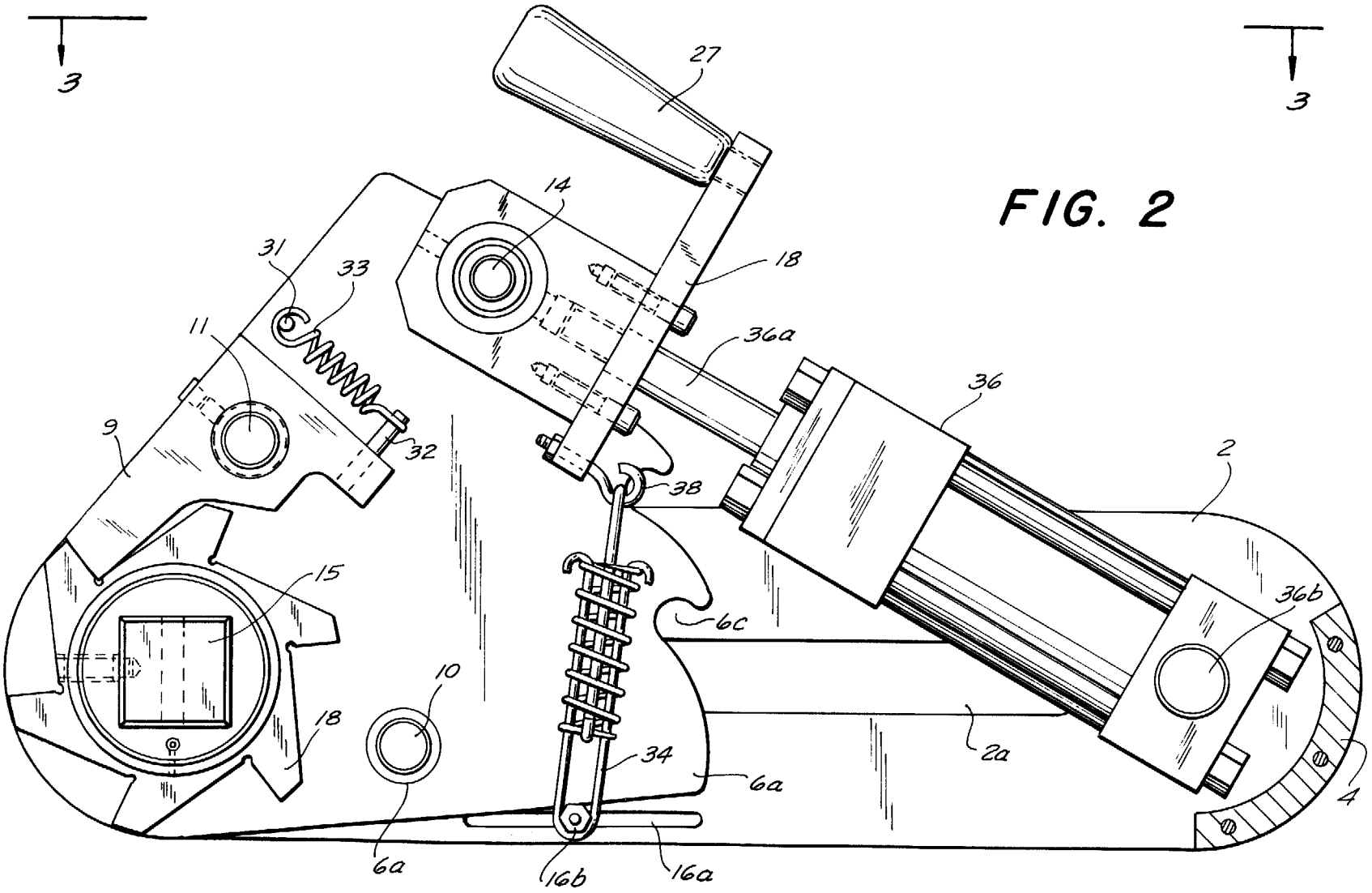
FIG. 2 is a side-elevational view of the torque wrench in FIG. 1, with portions omitted to show the interior assembly.
Figure 3:
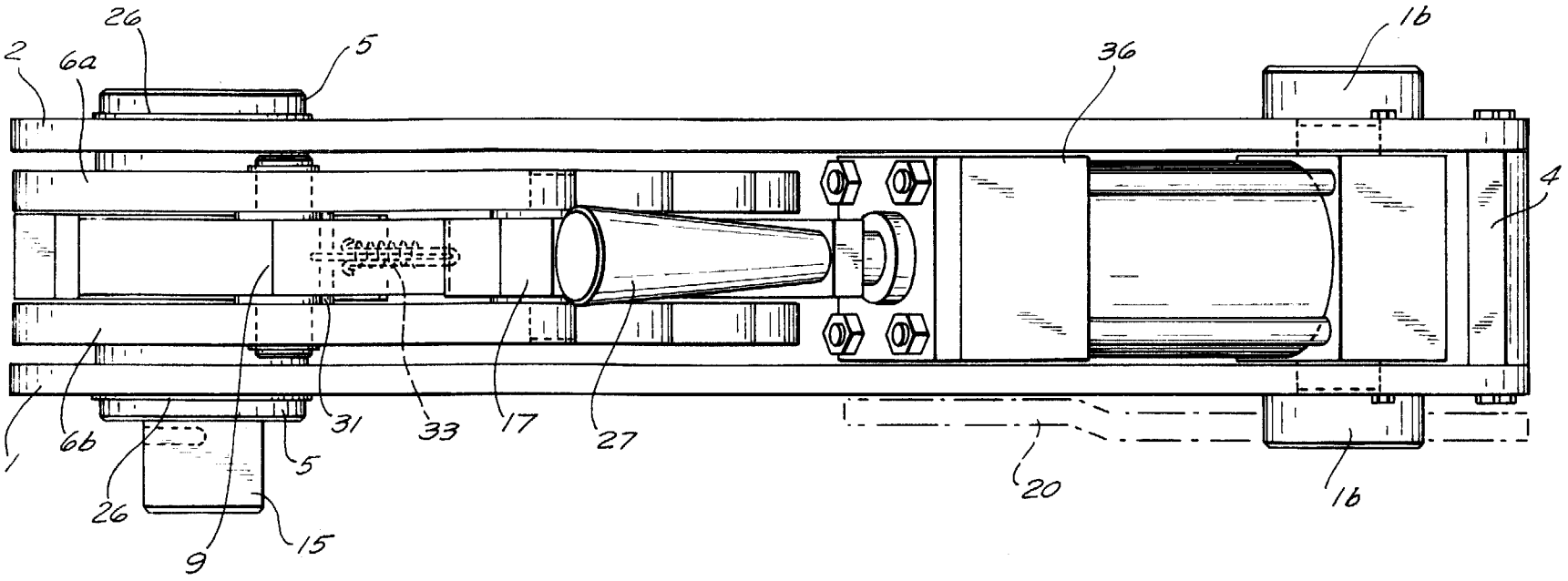
FIG. 3 is a top-plan view of the torque wrench in FIG. 1 in assembled condition.

The cycle is repeated as often as necessary. If, during such operation, the last of the slots 6*c* in the sector drive plates 6*a* and 6*b* has been engaged by the pin 14 and the sector drive plates have been turned for the final increment, the operator grips the handle 27 and pivots the cylinder unit 36 upwardly to disengage the pin 14 from the slots 6*c*, whereupon he manually tilts the sector drive plates 6*a*, 6*b* to their starting position, that is to the position that is shown in FIGS. 1 and 2. This motion engages the pawl 9 in the next tooth of the ratchet wheel 8.

The preceding operations are now repeated until the threaded fastener—assuming that it requires to be tightened—has been tightened to the desired torque. When reaching the desired torque, as determined by the setting of the pressure switch 50, the piston rod 36*a* returns to its retracted position and the wrench may now be removed.

Figure 6:
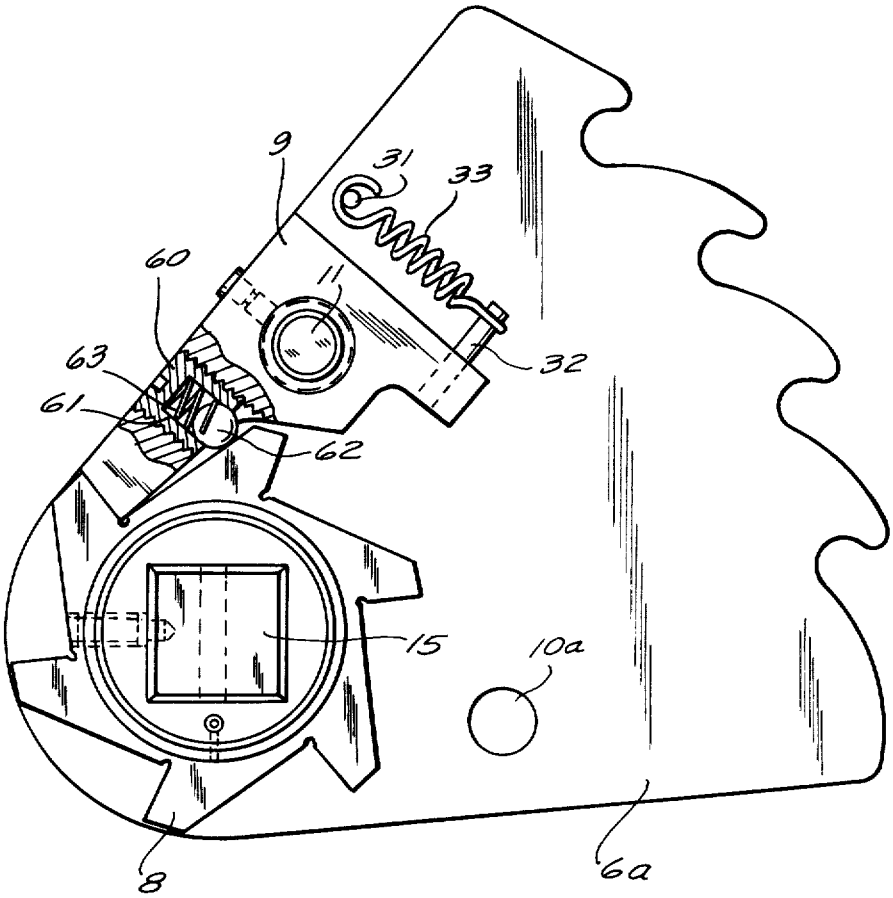
FIG. 6 is a fragmentary side view, partly sectioned, of another embodiment of the invention.

In certain operating positions of the tool the center of gravity of the sector drive plates 6*a*, 6*b* may be so located that these plates will tilt about the shaft 5 (in clockwise direction in FIG. 1) under their own weight. Since the pawl 9 is attached to and moves with the drive plates 6*a*, 6*b* it will then be lifted out of engagement with the ratchet drive wheel 8. To overcome this problem, the embodiment of FIG. 6 —wherein like reference numerals identify like components as before— utilizes a spring-loaded bolt plunger having a housing 60 that is threaded into or otherwise secured in a bore formed in the ratchet wheel-engaging portion of the pawl 9. The housing 60 has a bore 61 provided with an open end which is of a smaller diameter than the remainder of the bore 61, to retain a ball 62 therein. The edge bounding the open end may be secured over to achieve this, after ball 62 is inserted. A spring 63 is located in bore 61 and urges the ball 62 outwardly of the open end and into engagement with a respective tooth of ratchet wheel 8.

In this arrangement, the force of spring 63 which urges the ball 62 resiliently into contact with the ratchet wheel 8, overcomes the gravity-caused turning movement of the drive plates 6*a*, 6*b* (note the location of pawl shaft 11 in relation to ratchet wheel 8) so that, as long as the plunger movement is less than the movement of pawl spring 33, contact is maintained between pawl 9 and ratchet wheel 8 in all operating positions of the tool.

Of course, the housing 60 might be omitted and the ball 62 and spring 63 be directly accommodated in a bore of pawl 9.

It is clear that the wrench according to the present invention is simple in its construction and operates semiautomatically. It provides a high, controlled torque which is the same irrespective of whether the tool is used to tighten or to loosen a threaded fastener. The torque control is automatically accomplished through the preset adjustable pressure switch and the operator need not watch any gauges to assure that the desired torque is obtained. The semiautomatic operation speeds the work and provides for high efficiency. The overall dimensions of the novel wrench are small and the wrench can therefore be used even in applications where the availability of space is extremely limited. The final drive, that is the connection between the square drive member 15 and the threaded fastener to be tightened or loosened, is accomplished via standard socket wrenches that are readily available. The socket wrench that is used stays on the square drive member 15 until the operation is complete, and no periodic resettings of the drive sockets are required. The ratchet design of the novel wrench is uncomplicated, eliminating load sharing and other problems, and overall the novel wrench according to the present invention is a tool that can provide the user with a torquing system capable of handling the majority of industrial and private applications, such as overhaul and repair jobs. Because of its great simplicity, the wrench according to the present invention can be handled easily, and can be employed quite readily by unskilled labor, thus eliminating the expenses involved in the use of specially trained operators while at the same time assuring that none of the mishandling difficulties will occur which would ordinarily be expected when allowing the use of such a tool by an unskilled operator.

It will be understood that each of the elements described above, or two or more together, may also find a useful application in other types of constructions differing from the type described above.

While the invention has been illustrated and described as embodied in a hydraulic torque wrench, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hydraulic wrench, comprising a support; a drive assembly including a shaft journalled on said support and turnable relative thereto about a first axis, a sector drive plate turnable on said shaft and having an arcuate edge face formed with a plurality of slots spaced about said first axis and extending substantially parallel to the same, and a square drive member turnable with said shaft and adapted for insertion into a mating drive socket; transmission means for transmitting motion from said sector drive plate to said shaft so as to turn the latter; a hydraulic cylinder unit also mounted on said support for pivotal movement about a second axis spaced from and parallel to said first axis, said cylinder unit including a reciprocable piston rod having a working stroke; and a projection on said piston rod for engagement in the respective slots, so as to turn said sector drive plate on said shaft during the working stroke of said piston rod.

2. A hydraulic wrench as defined in claim 1, wherein said drive assembly includes on said shaft an additional turnable sector drive plate spaced from and substantially parallel to the first-mentioned one and also provided with an arcuate edge face having slots corresponding to the first-mentioned slots; and wherein said projection on said piston rod comprises a first portion engageable in the respective first-mentioned slots, and a second portion engageable in said slots of said additional sector drive plate.

3. A hydraulic wrench as defined in claim 2, wherein said transmission means comprises a ratchet wheel surrounding said shaft intermediate said sector drive plates and being turnable with said shaft, and a spring-loaded pawl pivotably mounted on said sector drive plates for movement with the latter and being in engagement with said ratchet wheel.

4. A hydraulic wrench as defined in claim 3; and further comprising a pair of circlips engaging said sector drive plates and maintaining the same against movement away from said ratchet wheel in axial direction of said shaft.

5. A hydraulic wrench as defined in claim 3, wherein said support comprises a pair of transversely spaced plate members located outwardly adjacent to the respective sector drive plates, and connecting means rigidly connecting said plate members to one another.

6. A hydraulic wrench as defined in claim 1, wherein said hydraulic cylinder unit includes a double-acting piston provided with said piston rod, and a hydraulic circuit for selectively moving said piston in mutually opposite directions.

7. A hydraulic wrench as defined in claim 6; further comprising quick-connect and -disconnect couplings for connecting said circuit with said hydraulic cylinder unit.

8. A hydraulic wrench as defined in claim 7, wherein said piston rod has a free end portion provided with a handle structure for engagement by an operator; and further comprising biasing means connected between said handle structure and said support so as to urge said hydraulic cylinder unit to tilt about a second axis and to maintain said projection in engagement with the respective slots.

9. A hydraulic wrench, comprising a support; a drive assembly mounted on said support and including a shaft turnable about a first axis, a sector drive plate turnable on said shaft and having an arcuate edge face formed with a plurality of slots spaced about said first axis and extending substantially parallel to the same, and a square drive member turnable with said shaft and adapted for insertion into a mating drive socket; transmission means for transmitting motion from said sector drive plate to said shaft so as to turn the latter, said transmission means comprising a ratchet wheel surrounding said shaft and turnable with the same and a spring-loaded pawl pivotably mounted on said sector driver plate for movement with the latter and being in engagement with said ratchet wheel; a hydraulic cylinder unit mounted on said support for pivotal movement about a second axis spaced from and parallel to said first axis, said cylinder unit including a reciprocable piston rod having a working stroke; and a projection on said piston rod for engagement in the respective slots, so as to turn said sector drive plate on said shaft during the working stroke of said piston rod.

* * * * *